United States Patent [19]

Ek

[11] 4,375,044

[45] Feb. 22, 1983

[54] LOW THERMAL STRESS ELECTRODE

[75] Inventor: Eric M. Ek, Tucson, Ariz.

[73] Assignee: The United States of America as represented by the Secretary of the Army, Washington, D.C.

[21] Appl. No.: 246,785

[22] Filed: Mar. 23, 1981

[51] Int. Cl.[3] ..... H01J 25/34; H01J 23/02

[52] U.S. Cl. ..... 315/5.38; 315/3.5

[58] Field of Search ..... 315/5.38

[56] References Cited

U.S. PATENT DOCUMENTS 2,955,225 10/1960 Sterzer ..... 315/5.38

3,098,165 7/1963 Zitelli ..... 315/5.38

3,293,480 12/1966 Green et al. ..... 315/5.38

*Primary Examiner*—Harold A. Dixon

*Attorney, Agent, or Firm*—Nathan Edelberg; Jeremiah G. Murray; Michael C. Sachs

[57] ABSTRACT

A collector for use in a travelling wave tube includes a central metallic core that has a peripheral ceramic insulator with the central metallic core having a plurality of circumferentially spaced primary slots extending inwardly from the periphery and an equal number of secondary slots extending perpendicular to the primary slots adjacent the periphery of the electrode. The primary slots define a plurality of fingers and the secondary slots act as hinges for the fingers.

9 Claims, 3 Drawing Figures

LOW THERMAL STRESS ELECTRODE

The Government has rights in this invention pursuant to Army contract DAAB-07-77-C-2713 awarded to Hughes Aircraft Co., Tucson, Ariz.

BACKGROUND AND FIELD OF THE INVENTION

The present invention relates generally to travelling wave tubes and, more particularly, to an improved collector for use in such tubes. As is known, a travelling wave tube comprises a wave propagating structure including an elongated tube in which an injected stream of electrons interacts continuously with the field of a guided electromagnetic wave moving substantially in synchronism with the stream of electrons such that there is a net transfer of energy from the stream to the wave.

Travelling wave tubes are commonly used in the communications field for amplification of radio-frequency signals. One type of travelling wave tube is disclosed in *Reference Data For Radio Engineers,* Pages 17-20 and 17-21. In such devices, the electron beam produced by an electron gun is directed through the elongated tube and is collected at the opposite end of the tube by a collector electrode. Usually the collector is in the form of a metallic central element that is surrounded by a ceramic insulator which has an inner metallized surface so that the electrode can be secured to the surface thereof.

One of the problems encountered with traveling wave tubes is the dissipation of the heat that is developed in the collectors, particularly multi-stage collectors that produce relatively high power outputs. Because of the differences in thermal expansion coefficients between the metal electrode, which is usually copper, and the ceramic insulator, significant tensile hoop stresses will be developed in the ceramic. Also, severe tensile stresses will arise between the metal and ceramic surfaces of the collector which are brazed to each other. Because of these high thermally-induced stresses, the ceramic insulator may fracture after only short periods of temperature cycling. In other instances, the metallized surface of the ceramic insulator may be pulled from the insulator by the metal.

Various techniques have been developed by various manufacturers to keep the thermal stresses within acceptable limits. One type of air-cooled collector that has been proposed has a plurality of elongated slots that are directed inwardly from the outer peripheral surface of the metal electrode to allow the metal electrode to expand without fracturing the ceramic insulator around the electrode. However, it was determined that such an arrangement resulted in a very high stress concentration at the joint between one edge of the slot and the adjacent metallized surface of the ceramic insulator. Analysis has indicated that only a slight increase in yield strength of the metal electrode would drive the stress in the braze joint above the tensile strength of the metallizing on the surface of the ceramic and, as stated previously, would result in failure due to the separation of the metallized surface from the ceramic insulator.

SUMMARY OF THE INVENTION

According to the present invention, a collector for a traveling wave tube has been developed which is capable of extensive temperature cycling without any adverse affects upon the insulator and upon the connection between the periphery of the metallic collector electrode and the adjacent surface of the ceramic insulator.

More specifically, the collector of the present invention includes a central electrode that is surrounded by a ceramic insulator with the adjacent surfaces brazed to each other and which has stress-relief means to accommodate the differences in the thermal expansion coefficients between the two materials. The stress-relief means is in the form of a plurality of elongated circumferentially-spaced slots that extend from the peripheral surface of the electrode and an equal number of secondary slots adjacent to the surface of the electrode. The elongated primary slots are substantially planar and have their planes offset from the center of the electrode, while the shorter secondary slots extend substantially perpendicular to the primary slots. In the illustrated embodiment, the primary slots have a length which is many times greater than the length of the secondary slots and the primary slots all terminate in a common radius spaced from the center of the electrode. In the specific embodiment illustrated, the primary slots define an angle of approximately 39° with respect to the plane extending normally to the peripheral surface of the electrode.

DESCRIPTION OF THE PREFERRED EMBODIMENT

Figure 1:
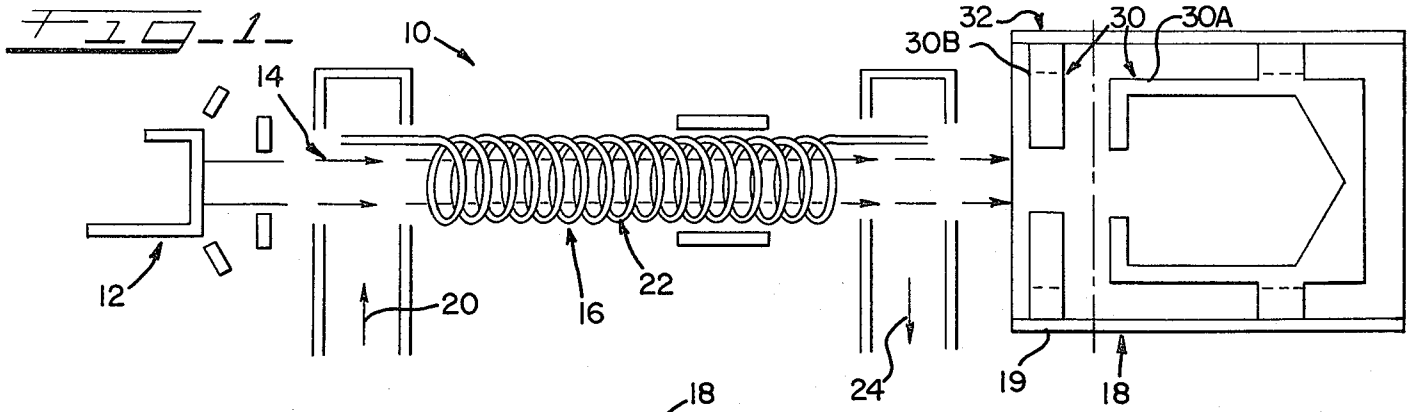
FIG. 1 shows a traveling wave tube having the present invention incorporated therein.

While this invention is susceptible of embodiment shown in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 generally discloses a traveling wave tube, generally designated by the reference numeral 10. As is well known, traveling wave tube 10 includes an electron gun 12 for supplying an electron beam 14 through an elongated tube 16 to a beam collector 18. A radio-frequency input 20 is provided at one end of tube 16 and coupled to a helix 22 capable of propagating an electromagnetic wave. The output 24 of tube 10 is initially coupled to an external circuit, not shown.

Figure 2:
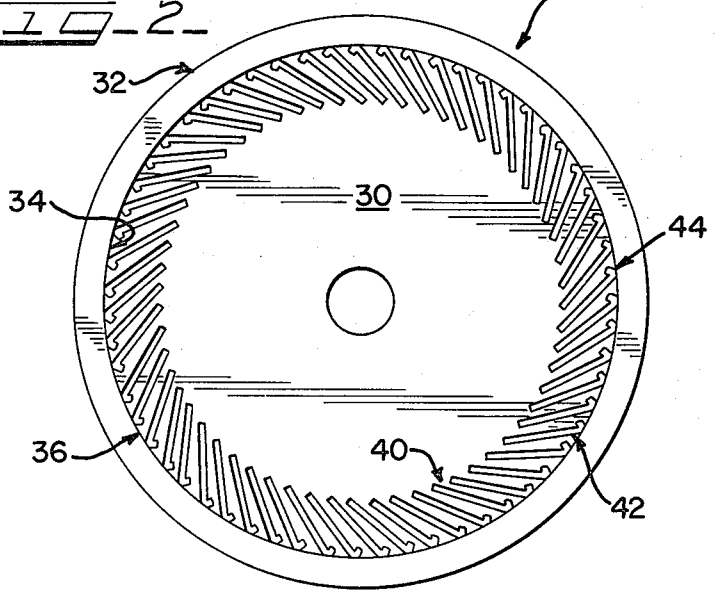
FIG. 2 is an end view of the collector used in the traveling wave tube of FIG. 1; and, FIG. 3 is an enlarged fragmentary view of the collector shown in FIG. 2.

The beam collector 18 is the subject matter of the present invention and is shown in FIGS. 1 and 2 of the drawings. As illustrated therein, the collector 18 includes one or more central metallic cores generally labeled 30 and a peripheral ceramic insulator 32. The insulator 32 has a metallized inner surface 34 which is secured, as by brazing, to each peripheral surface 36 of each central metal core.

In FIG. 1, the metallic cores generally numbered 30, and individually numbered 30A and 30B, are similar to one another, and each is formed in accordance with the inventive concept. As mentioned above, in certain applications, a collector 18 having only a single core such as 30A may be utilized. In this latter case, the portion of the collector 18 structure, shown to the left of the dot-dashed line in FIG. 1, and labeled 19, would be foreshortened; that is, omitted.

Figure 3:
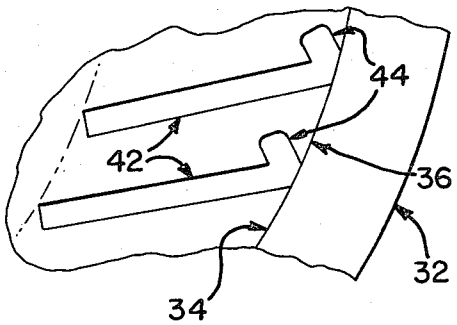

According to the present invention, the central metal cores 30, which are preferably formed of copper, include stress-relief means 40 to accommodate expansion and contraction of the metal electrode, with respect to the ceramic insulator. More specifically, the stress-relief means is in the form of a plurality of primary elongated slots 42 that extend from the peripheral surface 36 and terminate along a common radius spaced from the center of the metal electrode 30. The stress-relief means 40 also includes a plurality of secondary elongated slots 44 which extend from one edge of the primary slots 42. As illustrated in FIGS. 2 and 3, the primary slots 42 have a length which is many times greater than the secondary slots 44. Also, the secondary slots are located adjacent the peripheral surface 36 and extend substantially perpendicular to the planes of the primary slots 42.

In the illustrated embodiment of the invention, the elongated slots define flat planes which are angularly offset from the center of the electrode. As shown in FIGS. 2 and 3, the length of the primary slots is substantially less than the radius of the electrode and the planes of the primary slots define an angle which is preferably on the order of 39° with respect to a plane extending normal to the periphery of the electrode.

It has been found that the addition of the secondary slots 44 produces a hinge effect for each of the fingers produced between adjacent pairs of primary slots which substantially increases the fillet radius and greatly reduces the bending moment at the metal/-ceramic brazed joint between the insulator and the electrode. The reduction in stress concentration and bending moment dramatically reduces the stress at this joint. Analysis has shown that the short secondary slots, positioned as illustrated, will allow the electrode to be subjected to substantial temperature cycling without any failure of the joint between the ceramic insulator and the metal electrode.

By way of example and not of limitation, a collector having a diameter of approximately 4-inches, which has a central metal electrode formed from copper and brazed to a peripheral ceramic insulator having a thickness of 0.18 inches, was subjected to extensive temperature recycling. An assembly was initially raised from room temperature to approximately 525° C., reduced to room temperature, and again raised to the same temperature. The collector was then cycled ten times from room temperature to approximatey 250° C. The same collector was then temperature cycled twenty times from room temperature to about 300° C. A careful analysis was then made of the collector, and examination showed that there was no damage whatsoever to the integrity of the ceramic or the integrity of the joints between the insulator and the peripheral surface of the electrode.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. A traveling wave tube having means for supplying a beam to one end of the tube and a collector which receives said beam at an opposite end of said tube said collector comprising a metal electrode having a ceramic insulator secured to the periphery thereof and stress-relief means for said electrode including a plurality of spaced substantially planar primary slots extending from the periphery of said metal electrode, with planes offset from the center of said metal electrode, and secondary slots extending from at least one edge of said primary slots.

2. A traveling wave tube as defined in claim 1 in which said secondary slots extend substantially perpendicular to said primary slots.

3. A traveling wave tube as defined in claim 2 in which said secondary slots are located adjacent outer ends of said primary slots.

4. A traveling wave tube as defined in claim 3 in which said electrode and insulator are circular.

5. A traveling wave tube as defined in claim 4 in which said primary slots have a length many times greater than said secondary slots.

6. A collector for use in a traveling wave tube comprising a circular elongated center electrode and a surrounding ceramic insulator having abutting surfaces secured to each other including means defining a plurality of circumferentially spaced primary slots extending from the surface of electrode, said primary slots being substantially planar with planes offset to one side of the center of the electrode, and an equal number of short secondary slots formed contiguous with the edge of respective primary slots and adjacent the periphery of said electrode.

7. A collector as defined in claim 6 in which inner edges of said primary slots terminate at a common radius from said center.

8. A collector as defined in claim 7 in which all of said secondary slots are of substantially equal length.

9. A collector as defined in claim 8 in which said secondary slots extend substantially perpendicular to said primary slots.

* * * * *